United States Patent [19]

Kostanecki

[11] 4,161,796

[45] Jul. 24, 1979

[54] MONOLITHIC POLYMER FOAM SAILBOAT HULL

[75] Inventor: Andrew T. Kostanecki, Darien, Conn.

[73] Assignee: Kransco Manufacturing, Inc., South San Francisco, Calif.

[21] Appl. No.: 804,321

[22] Filed: Jun. 7, 1977

[51] Int. Cl.[2] ..... B63B 3/00

[52] U.S. Cl. ..... 9/6 P; 114/39; 114/162

[58] Field of Search ..... 9/6 R, 6 M, 6 P, 3, 9/4 R, 1.1; 114/39, 162, 163, 164, 90

[56] References Cited

U.S. PATENT DOCUMENTS

| | | | |
|---|---|---|---|
| 3,064,283 | 11/1962 | Swanson | 9/6 M |
| 3,269,347 | 8/1966 | Koenig | 114/162 |
| 3,291,088 | 12/1966 | Klose | 9/6 P X |
| 3,806,971 | 4/1974 | Elling | 9/3 |
| 3,839,978 | 10/1974 | Hendrickson | 114/39 |
| 3,903,830 | 9/1975 | Tanzer | 114/162 |

OTHER PUBLICATIONS

"Backyard Boats", 100 Franklin Streets, Alexandria, Va. 22314, Feb. 1975.

*Primary Examiner*—Trygve M. Blix
*Assistant Examiner*—Sherman D. Basinger
*Attorney, Agent, or Firm*—Naylor, Neal & Uilkema

[57] ABSTRACT

A sailboat hull comprised of a monolithic structure fabricated of low-density polymer foam and having integrally formed therewith an internal H-shaped structure. The H-shaped structure serves to reinforce the hull and provides buoyancy chambers extending along either side of the hull and a centerboard trunk medially of the hull. The chambers define leg space therebetween and are so proportioned that said leg space is buoyantly supported above the surface of the water when the hull is in a tipped vertically disposed position. The hull is provided with a rudder comprised of a pair of separate cheek plates vertically disposed in spaced parallel relationship to one another and held in this position by extruded aluminum pintle blocks secured between the plates. The pintle blocks extend forwardly of the plates and carry aligned pintle pins. A tiller is fixedly attached between the upper edges of the plates and the rudder is pivotally secured between the plates beneath the tiller.

13 Claims, 9 Drawing Figures

MONOLITHIC POLYMER FOAM SAILBOAT HULL

BACKGROUND OF THE INVENTION

The present invention relates to a sailboat hull and, more particularly, to a hull for a sailing dinghy. In its more specific aspects, the invention is concerned with such a hull fabricated of foam plastic material having a high-density plastic skin.

Sailing dinghies are well known in the prior art and, typically, are of the centerboard type and have some accommodation for propulsion by a small outboard motor. The most conventional of such dinghies are presently fabricated of fiber glass or aluminum. Certain of such dinghies have also been fabricated of an expanded polymer foam core covered with a high-density plastic skin. The hull of the present invention has the latter type of construction.

Sailboat hulls of the type constructed of expanded polymer foam covered with a high-density plastic skin are known to have integrally molded therewith laterally disposed seat portions which form flotation chambers. Such hulls are also known to have integrally molded therewith a centrally disposed centerboard trunk. These elements (i.e., the seat portions and trunk) have not, however, been formed so that the trunk forms part of an integral monolithic portion of the hull tying the seat portions and the sides of the hull together. Such hulls also have not employed seat portions which extend forwardly and rearwardly of the centerboard trunk and merge therewith.

A sailing dinghy typical of the type having an expanded polymer foam core and a high-density skin is the MAYFLOWER dinghy of Snark Products, Inc., of North Bergen, N.J. The hull construction of the MAYFLOWER dinghy is similar to the typical construction described above in that the centerboard trunk does not extend across and merge with the seat portions and side of the hull. In the MAYFLOWER hull, a wooden bench ties the centerboard trunk to the sides of the hull and the seat portions do not extend forwardly of the trunk.

SUMMARY OF THE INVENTION

The hull of the present invention is characterized in that it is fabricated of a low-density polymer foam having integrally formed therewith an internal H-shaped structure having a generally trapezoidal cross-sectional configuration diverging from top to bottom. The H-shaped structure defined a cross member extending transversely across the hull and seat members extending along the sides of the hull, said cross member merging with the bottom and opposite sides of the hull and having a centerboard trunk formed therein. The seat members define a leg space therebetween and extend forwardly and rearwardly of the cross member and merge with the cross member and the sides and transom of the hull. The seat portions are so proportioned that the leg space is buoyantly supported above the surface of a body of water when the hull is in a tipped vertically disposed position. As a result, during righting of the hull after it has capsized, the interior of the hull (i.e., the leg space between the seat portions) empties.

A principal object of the present invention is to provide a sailboat hull comprised of a monolithic structure fabricated of low-density polymer foam wherein the structure includes as an integral part thereof an internal H-shaped structure which functions to reinforce the hull and provides seat portions and a centerboard trunk therein.

Another and related object of the invention is to provide such a hull wherein the H-shaped structure defines leg space within the hull and the seat portions are so proportioned as to maintain said space above the water level when the hull is tipped to a vertical disposition in a body of water.

Still another object of the invention is to provide such a hull wherein the monolithic structure includes deck supports which merge with the seat portions and a mast step disposed intermediate of the deck supports.

The foregoing and other objects will become more apparent when viewed in light of the accompanying drawings and following detailed description.

DESCRIPTION OF THE PREFERRED EMBODIMENT

Figure 1:
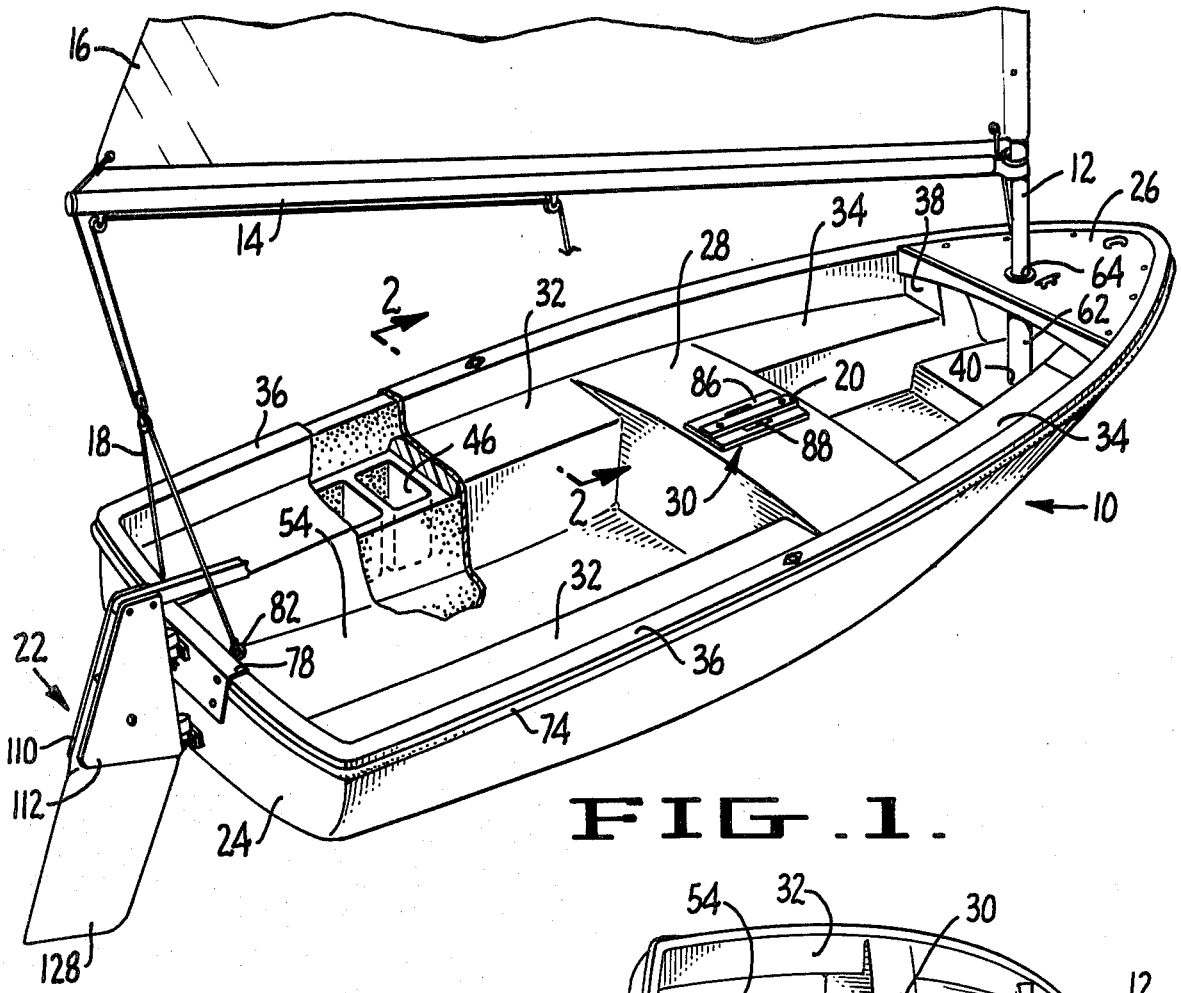
FIG. 1 is a perspective view of a sailboat embodying the hull and rudder of the present invention, with portions of the mainsail and mast broken away.

Referring now to FIG. 1, the sailboat hull is designated therein in its entirety by the numeral 10. As shown the hull is rigged with a mast 12, a boom 14, a mainsail 16, a bridle 18, a centerboard 20 and a rudder assembly 22. The basic elements of the hull comprise: a transom 24; a deck 26; a cross member 28 defining a centerboard trunk 30 therein; and seat members extending along the sides of the hull forwardly and rearwardly of the cross member, said seats each comprising a rearward portion 32 and a forward portion 34. Gunwales 36 extend along the length of the hull and deck supports 38 are disposed forwardly of the seat portions 34 in close proximity to the level of the gunwales. A mast step 40 is formed in the bottom of the hull intermediate the deck supports 38.

The hull is of a monolithic construction, and comprises a molded core, generally designated by the numeral 42, fabricated of expandable polystyrene (EPS) having a density of from one and one-half to three pounds per cubic foot. Such material is well known in the art and ideally suited for EPS foam molding. In the preferred embodiment, the polystyrene core is formed so as to have a minimum thickness of two inches. The hull is covered with a kin of acrylonitrile butadiene styrene (ABS), designated generally by the numeral 44, which is vacuum drawn into intimate contact with the core. The skin may take any of the commercially available forms of high-density ABS material, such as CYCOLAC GS manufactured by the Borg-Warner Corporation, or LUSTRAN LS manufactured by the Monsanto Company. A 0.090 inch gauge ABS material has been found ideal. Such a gauge will have a thickness of in the neighborhood of 0.080 inches at its thickest points where drawing is least, and a thickness of about 0.025 inches at the points of deepest draw (e.g., the interior floor of the hull).

Although expandable polystyrene has proved ideal for the core of the hull, other expanded polymer materials could be employed. An example of an alternate foam material is expanded polyurethane. It is also possible that the high-density polymer skin material might take a form other than acrylonitrile butadiene styrene. For example, it could take the form of an ABS material laminated or coated with another plastic, such as acrylic, to prevent ultraviolet deterioration.

Figure 2:
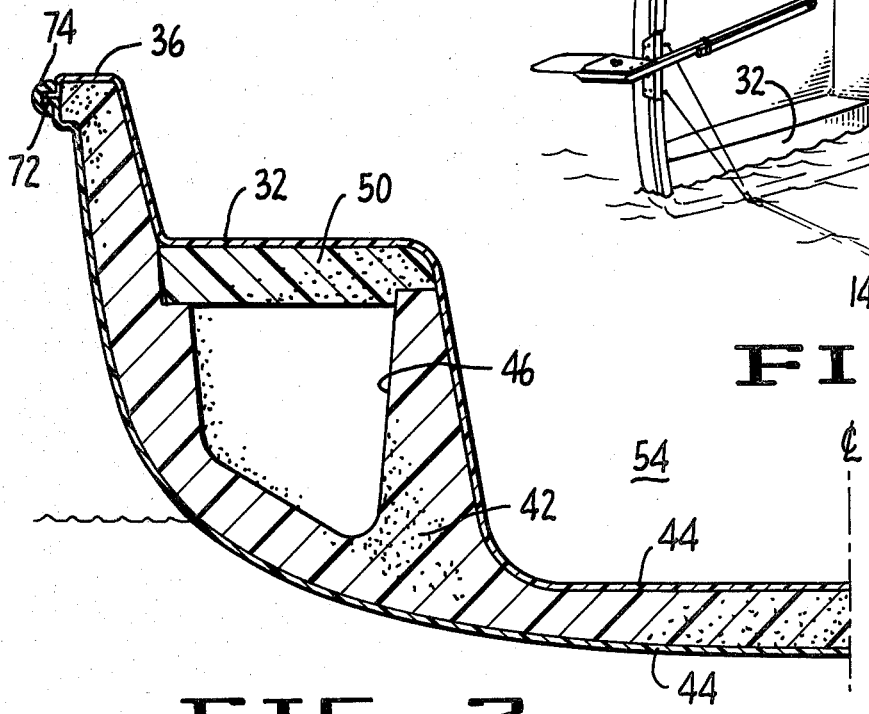
FIG. 2 is a cross-sectional view taken on the plane designated by Line 2—2 of FIG. 1.
Figure 4:
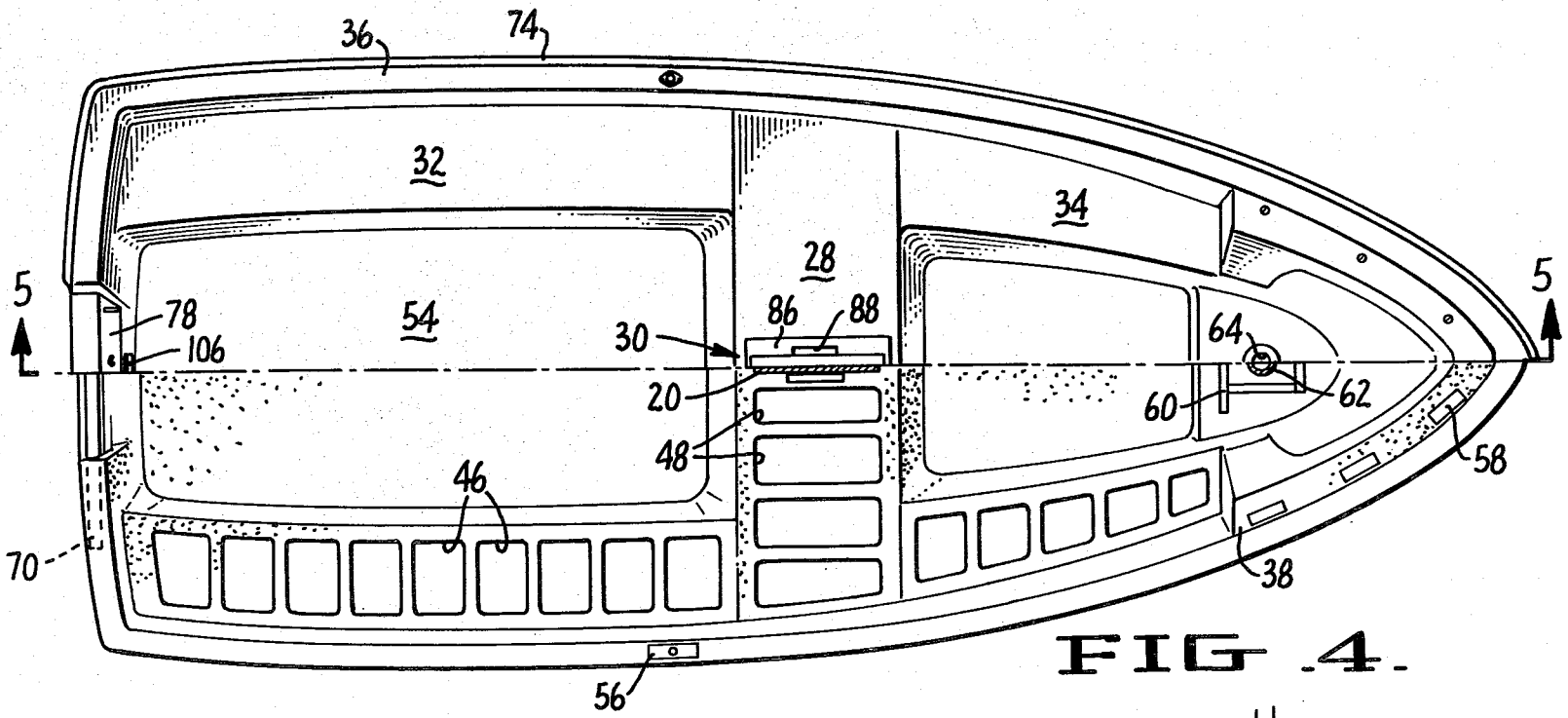
FIG. 4 is a top plan view of the hull, with the skin and seat tops removed from part thereof.

The cross member 28 and the forward and rearward portions of the seat members are integrally molded with the hull and, as viewed in plan (See FIG. 4), define a generally H-shaped configuration. As viewed in cross-section (See FIGS. 2 and 4), these members are of generally trapezoidal configuration and diverge from top to bottom. In the preferred embodiment, the seat and cross members are formed with internal pockets 46 and 48, respectively, opening through the upper surfaces of the core of the hull. Prior to application of the skin 44, these pockets are covered with cap members 50 and 52, respectively, fabricated of the same type of expanded polymer foam as the core. The pockets reduce the overall weight of the hull, conserve core material and avoid very thick hull sections. The avoidance of thick hull sections has the advantage that it minimizes the curing cycle time for the core material. In the preferred embodiment, the pockets have a maximum width of about six inches and a depth chosen to maintain the minimum thickness of the hull core at two inches.

Figure 3:
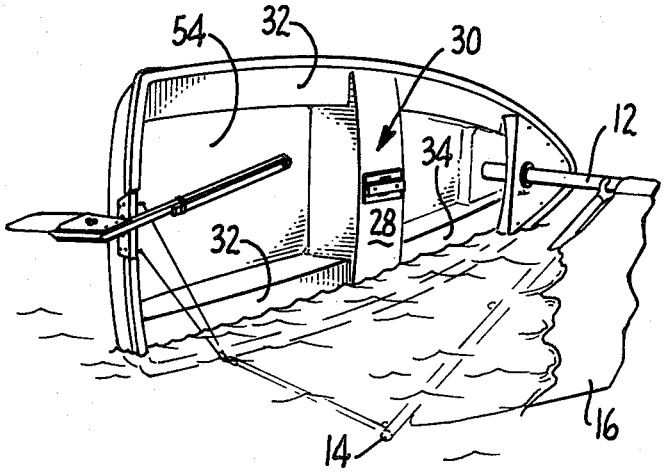
FIG. 3 is a perspective view of the sailboat, disposed in a tipped vertical orientation, illustrating the manner in which the hull floats in a body of water when so tipped.

The H-shaped structure provided by the seat members and the cross member serves to reinforce the hull and provide buoyancy chambers along the sides of the hull so proportioned that the leg space, designated 54, between the seat members is above the water line when the hull is tipped to a vertical disposition, as seen in FIG. 3. This feature makes the hull essentially self-bailing when it is moved from a tipped position to the normal upright position, since any water within the leg space will spill therefrom as the hull is righted. The trapezoidal cross-sectional shape of the seat and cross members also contributes to this self-bailing function.

In the preferred embodiment, the seat members each have a cross-sectional width at any point along the length thereof equal to between fifteen and thirty percent of the width of the hull. With this ratio, the upper surfaces of the seats in the ultimate hull are disposed at a level spaced beneath the gunwale line of the hull by a distance equal to at least twenty-five percent of the depth of the hull, as measured from the keel to the level of the gunwale line.

The seat members and cross member merge with the hull through smooth fillets. Such fillets enhance the structural integrity of the hull and also contribute to the self-bailing function. The cross member merges with the bottom and opposite sides of the hull and the seat members merge with the cross member and the sides and transom of the hull. The deck supports 38 merge with the seats, bottom and sides of the hull.

The core of the hull is provided with a number of inserts for the purpose of structural integrity and/or facilitating the attachment of various elements to the hull. Oarlock inserts 56 are provided in each gunwale. Wooden deck anchoring inserts 58 are provided at spaced positions along the deck supports 38. A generally box-shaped insert 60 is provided in the bottm of the hull intermediate the deck supports to provide a mast step, including the socket therefor. Ultimately, the socket receives a metal tube 62 which forms a part of the mast step and extends through an opening 64 therefor in the deck 26. The opening 64 snugly receives the tube 62 and provides lateral support for the tube. A generally rectangular wooden insert 66 extends around the centerboard trunk opening at the bottom of the hull. An angle-shaped aluminum insert 70 is disposed along the inner top center portion of the transom.

Figure 6:
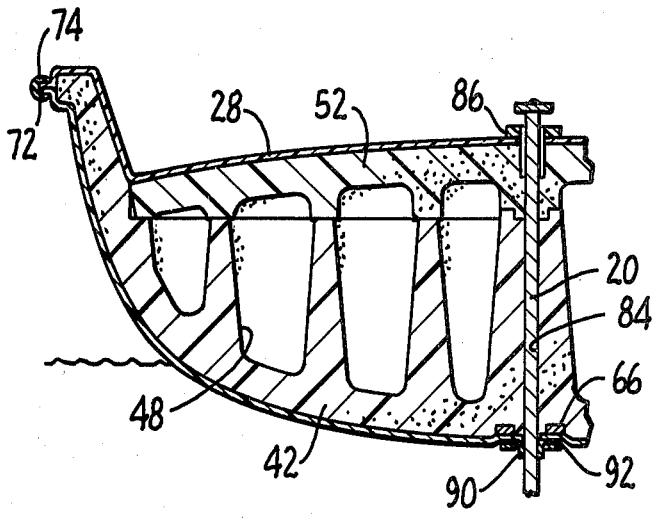
FIGS. 6 and 7 are cross-sectional views, taken on the planes designated by Lines 6—6 and 7—7, respectively, of FIG. 5.
Figure 7:
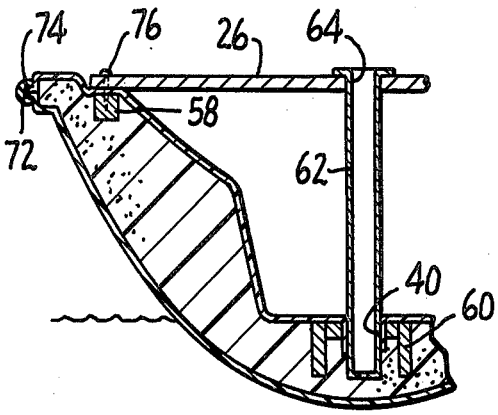
Figure 8:
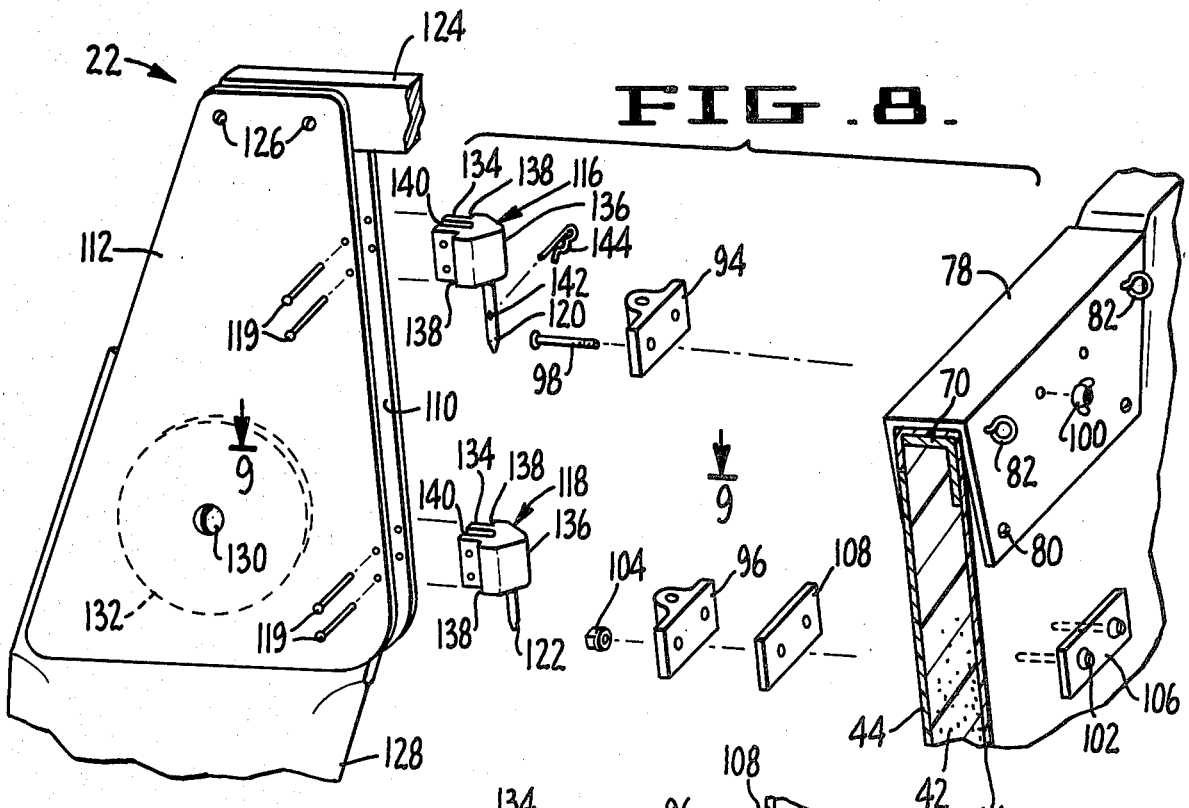
FIG. 8 is an exploded perspective view, with parts thereof broken away and shown in section, illustrating the transom of the hull and the rudder assembly; and, FIG. 9 is a cross-sectional view taken on the plane designated by Line 9—9 of FIG. 8.

After the core of the hull has been formed and cured, with the various inserts in place, and the cap members 50 and 52 have been placed, the ABS skin is vacuum drawn over the hull to provide continuous skin covering all hull surfaces. The skin is applied in two layers, one covering the outside of the hull and the other covering the inside. The layers join at the gunwale and transom line to define a flange 72 extending around the upper periphery of the hull, with the exception of the center portion of the transom. The flange (See FIGS. 6 and 7) has received therearound a resilient rub rail 74 of rubber or the like. As viewed in cross-section, the rub rail is of a semicircular configuration and grooved along one side for receipt of the flange 72. A suitable adhesive may be employed to secure the rub rail against displacement from the flange.

Once the hull is complete to the extent that the ABS skin is fully applied, the various fittings are secured in place. The deck 26 is secured to the deck supports 38 through means of screws 76 extending through the deck and into engagement with the inserts 58. The mast step is completed by inserting the metal tube 62 through the opening 64 provided therefor in the deck and into engagement with the socket provided by the portion of the mast step molded within the hull. The transom assembly is completed by securing a generally channel-shaped metal plate 78 over the center portion of the transom through means of bolts 80 extending through the transom. The plate 78 reinforces the transom and provides a hull section to which a small outboard motor may be mounted, when the tiller assembly 22 is removed from the hull. The plate 78 also carries eyes 82 to which the bridle 18 may be secured.

Figure 5:
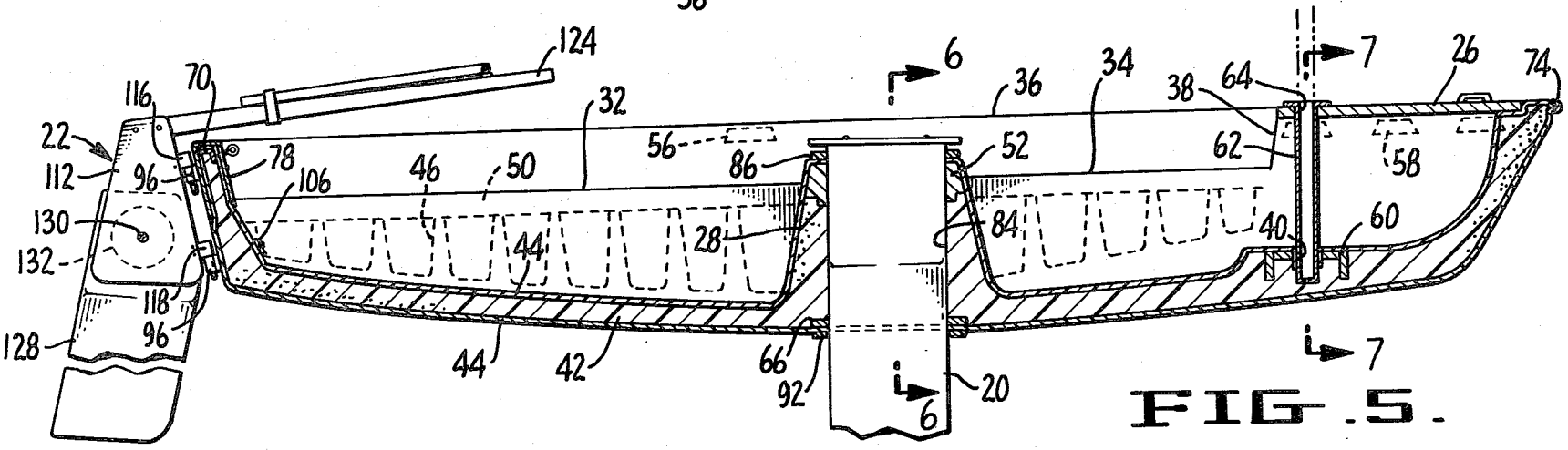
FIG. 5 is a cross-sectional view, taken on the plane designated by Line 5—5 of FIG. 4.

The passage for the centerboard trunk 30 is molded in the hull during molding of the core material and extends through the cross member 28 and the cap 52 therefor. As can be seen from FIG. 5, the passage is designated by the numeral 84 and the insert 66 extends around the lower end thereof. The centerboard 20 is slidably received within the passage 84. The upper end of the passage 84 has secured therearound an escutcheon plate 86 having recesses 88 in either side thereof to facilitate gripping of the upper end of the centerboard. The plate 86 may be fabricated of a polymer plastic material and adhesively secured in place. The lower end of the passage 84 is covered by a gland 90 fabricated of a resilient material, such as mylar, and slit over the length of the passage to permit the centerboard to pass through the gland. The gland is held in place by an ABS escutcheon plate 92 extending around the lower end of the passage 84 and secured in place by screws (not illustrated) extending through the plate and into engagement with the insert 66.

In use, the gland 92 frictionally engages the centerboard 20 when the centerboard is extended therethrough and, thus, prevents inadvertent displacement of the centerboard from the centerboard trunk. The gland also functions to close the passage 84 when the centerboard is removed and the hull is being propelled by a non-sail propulsion means, such as an outboard motor.

Figure 9:
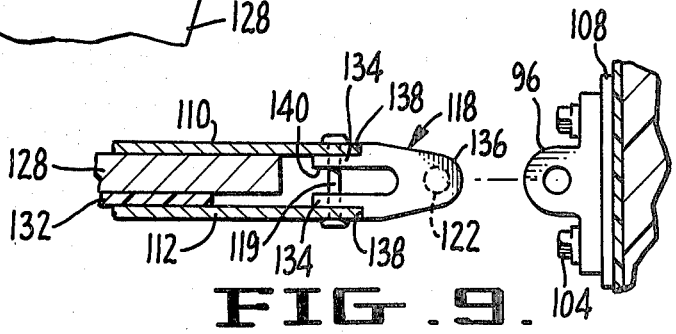

The rudder assembly 22 is secured to the transom 24 by gudgeons 94 and 96 (See FIG. 9). The gudgeon 94 is held in place by throughbolts 98 extending through the gudgeons and the transom and threadably receiving on the inner ends thereof wingnuts 100. The wingnuts 100 facilitate easy removal of the gudgeon 94 in the event it is desired to secure an outboard motor to the transom. The gudgeon 96 is held in place by throughbolt 102 extending through the transom and having nuts 104 received on the outer ends thereof. The heads of the bolts 102 seat against a bearing plate 106 provided therefor on the inner side of the hull. As shown in FIG. 9, a spacer plate 108 is disposed between the gudgeon 96 and the outside of the hull.

In addition to the gudgeons and the mounting means therefor, the rudder assembly comprises: a pair of vertically disposed parallel cheek plates 110 and 112, said plates being flat and separate from one another and of a generally frutotriangular planar configuration; pintle blocks 116 and 118 disposed in vertically aligned relationship and fixedly secured between the leading edges of the plates 110 and 112 by throughbolts 119 extending through the plates and the blocks, said blocks carrying aligned pintle pins for receipt in the gudgeons 94 and 96; a tiller 124 fixedly secured between the upper ends of the plates 110 and 112 by screws 126; a rudder 128 pivotally secured between the plates 110 and 112 by a bolt 130 extending through the plates in an opening provided therefor in the rudder; and, a friction pad 132 interposed between the plate 112 and one side of the rudder 128. The bolt 130 threadably receives a nut (not illustrated) to the outside of the plate 110 and may be selectively threaded into and out of the nut to adjust the compression of the friction pad and the rudder. The friction pad may be fabricated of any conventional material used for such purposes, such as expanded polyethylene sheet.

The pintle blocks 116 and 118 are of identical construction and each comprise a base portion 134 proportioned for receipt between the plates 110 and 112; an enlarged head portion 136 having the pintle pin carried by the block fixedly secured thereto; and, shoulders 138 at either side thereof at the merger between the base and head portions. The shoulders are configured to engage the leading edges of the check plates and, preferably, have a depth equal to the thickness of the plates.

Each block is formed with a groove 140 extending over its length and opening through the rear surface thereof. The pintle pins 120 and 122 are fixedly received within openings provided therefor in the blocks. The pin 120 has an aperture 142 extending transversely therethrough for receipt of a keeper pin 144. The keeper pin is of conventional "hair-pin" type construction and is inserted through the pin 120 beneath the gudgeon 94 to secure the rudder assembly against inadvertent displacement from the gudgeons. When it is desired to remove the rudder assembly from the gudgeons, it is simply necessary to remove the pin 144 and lift the assembly upwardly.

The aforementioned construction of the pintle blocks 116 and 118 ideally suits the blocks for fabrication from segments of an aluminum extrusion. Such an extrusion may be formed as a continuous length and the blocks are simply cut from the length. The apertures in the blocks for receipt of the pintle pins and the securing throughbolts are formed after the extruding process by drilling.

EXAMPLE

The following is a typical example of the specifications of a hull fabricated according to the present invention:

Core material: Expandable polystyrene having a density of two pounds per cubic foot
Skin material: 0.090 inches gauge CYCLOAC GS ABS
Minimum core thickness: 2 inches
Hull length: 11 feet 4 inches
Hull beam: 58 inches
Hull weight: 90 pounds Such a hull would typically have a depth, as measured from the keel line to the gunwale line, of approximately ninteen inches at the stern and twenty-two inches at the bow. The transom would measure approximately fifty-two inches. The centerboard trunk opening would be approximately twelve inches in length and one inch in width. The seat height and width would fall within the range described in the foregoing specification, with the seat width at its upper surface measuring from eight and one-half to ten inches. The centerboard trunk would have a width measuring from approximately sixteen inches to eighteen inches.

The foregoing dimensions are simply intended to be representative of a typical hull designed according to the present invention. These dimensions are not intended to be all inclusive. The hull shown in the accompanying drawings is proportioned to scale and is that of an exemplary hull having a length of eleven feet four inches, a beam of fifty-eight inches, and a weight of ninety pounds.

CONCLUSION

From the foregoing detailed description, it is believed apparent that the invention enables the attainment of the objects initially set forth herein. It should be understood, however, that the invention is not intended to be limited to the specifics of the illustrated embodiment, but rather is defined by the accompanying claims.

What is claimed is:

1. A sailboat hull comprising a monolithic structure of low-density polymer foam, said hull having integrally formed therewith a structural reinforcement core in the form of an internal H-shaped structure defining a cross member extending transversely across the hull and seat members extending along and disposed inwardly of the sides of the hull, said seat members terminating short of the bow of the hull, said cross member merging with the bottom and opposite sides of the hull and having a centerboard trunk formed therein, said seat members defining leg space therebetween and extending forwardly and rearwardly of the cross member and merging with the cross member and the sides and transom of the hull and said hull having integrally formed therewith, in front and in merging relationship with the seats and the bottom of the hull, deck supports extending to a level in close proximity to the gunwale line of the hull.

2. A sailboat hull comprising a monolithic structure fabricated of low-density polymer foam, said hull having integrally formed therewith an internal H-shaped structure defining a cross member extending across the hull and seat members extending along the sides of the hull, said cross member merging with the bottom and opposite sides of the hull and having a centerboard trunk formed therein, said seat members defining leg space therebetween and extending forwardly and rearwardly of the cross member and merging with the cross member and the sides and transom of the hull, said seat members, together with the sides of the hull, defining a composite structure of sufficient breadth to buoyantly support the hull, when tilted in a vertical disposition in a body of water, at a level wherein the leg space between the seat members is above the level of the body of water.

3. A hull, according to claim 2, wherein said polymer foam comprises polystyrene having a density of from one and one-half to three pounds per cubic foot.

4. A hull, according to claim 3, wherein said seat members each have a cross-sectional width at any point along the length of the hull equal to between fifteen and thirty percent of the width of the hull.

5. A hull, according to claim 4, wherein the tops of the seat members are disposed at the level spaced beneath the gunwale line of the hull by a distance equal to at least twenty-five percent of the depth of the hull, as measured from the bottom of the keel to the level of the gunwale line.

6. A hull, according to claim 3, wherein said monolithic structure, including the integrally formed internal H-shaped structure, is covered with a layer of high-density acrylonitrile butadiene styrene sheet.

7. A hull, according to claim 3, wherein said cross member and seat members are formed with internal air pockets opening through the upper surfaces thereof and further comprising cap members over said cross member and seat members to close the pockets therein.

8. A hull, according to claim 7, wherein said monolithic structure, including the integrally formed internal H-shaped structure and the cap members for the cross member and seat members, are covered with a layer of high-density acrylonitrile butadiene styrene sheet.

9. A hull, according to claim 2, wherein said seats terminate short of the bow of the hull and the hull has integrally formed therewith, in front of and in merging relationship with the seats and the bottom of the hull, deck supports extending to a level in close proximity to the gunwale line of the hull.

10. A hull, according to claim 9, wherein a mast step is integrally formed in the bottom of the hull between the deck supports.

11. A hull, according to claim 10, further comprising a deck secured to and supported by said deck supports, said deck having a mast opening formed therein in vertical alignment with the mast step in the hull.

12. A sailboat hull comprising a monolithic structure of polystyrene foam having a density of from one and one-half to three pounds per cubic foot, said hull having integrally formed therewith a structural reinforcement core in the form of an internal H-shaped structure defining a cross member extending transversely across the hull and seat members extending along and disposed inwardly of the sides of the hull, said seat members each having a cross-sectional width at any point along the length thereof equal to between fifteen and thirty percent of the width of the hull, said cross member merging with the bottom and opposite sides of the hull and having a centerboard trunk formed therein, said seat members defining leg space therebetween and extending forwardly and rearwardly of the cross member and merging with the cross member and the sides and transom of the hull, said cross member and seat members being formed with internal air pockets opening through the upper surfaces thereof; and cap members over said cross member and seat members to close the pockets therein.

13. A hull, according to claim 12, wherein said monolithic structure, including the integrally formed internal H-shaped structure and the cap members for the cross member and seat members, are covered with a layer of high-density acrylonitrile butadiene styrene sheet.

* * * * *